US006135456A

United States Patent [19]

Cooper

[11] Patent Number: 6,135,456

[45] Date of Patent: Oct. 24, 2000

[54] TARGET APPARATUS AND METHODS FOR PLAYING NEW TARGET GAMES

[76] Inventor: Stephen R. Cooper, P.O. Box 476, Riverside, Conn. 06878-0476

[21] Appl. No.: 09/275,607

[22] Filed: Mar. 24, 1999

Related U.S. Application Data

[60] Provisional application No. 60/079,244, Mar. 25, 1998.

[51] Int. Cl.[7] ..... F41J 5/02; A63B 69/00

[52] U.S. Cl. ..... 273/371; 273/348; 473/459; 473/467; 434/11

[58] Field of Search ..... 473/459, 467–469, 473/131, 219–225, 407, 409; 463/4, 5; 434/11, 16, 19, 21–23; 273/371–376

[56] References Cited

U.S. PATENT DOCUMENTS

| | | | |
|---|---|---|---|
| 3,727,069 | 4/1973 | Crittenden, Jr. et al. | 273/371 |
| 3,989,246 | 11/1976 | Brown et al. | 273/371 |
| 4,563,005 | 1/1986 | Hand et al. | 473/467 |
| 4,763,903 | 8/1988 | Goodwin et al. | 273/371 |
| 5,328,190 | 7/1994 | Dart et al. | 273/371 |
| 5,577,733 | 11/1996 | Downing | 273/371 |
| 5,816,953 | 10/1998 | Cleveland | 473/459 |

*Primary Examiner*—Mitra Aryanpour
*Attorney, Agent, or Firm*—Gottlieb Rackman & Reisman, P.C.

[57] ABSTRACT

A target apparatus for use in playing new target games comprises a frame within which one or more of a plurality of target zones may be visually designated, with the location of the visually designated target zone(s) changing over time in accordance with a predetermined pattern. Methods for utilizing the apparatus to play new target games are also described. Rules for three new target games (entitled SINGLES TARGET TENNIS, DOUBLES TARGET TENNIS and TEAM TARGET TENNIS) are disclosed in detail, although the apparatus may also be used to play additional target games. Electronic versions of the new target games are also disclosed.

9 Claims, 5 Drawing Sheets

TARGET APPARATUS AND METHODS FOR PLAYING NEW TARGET GAMES

This application claims benefit of provisional application Ser. No. 60/079,244 filed Mar. 25, 1998.

FIELD OF INVENTION

The present invention pertains generally to games, and more particularly to court games and to target games. A court game (such as lawn tennis) is one that is played by one or more players in a large open space with at least one ball or other projectile, with visual indicia demarcating the boundaries of the court, and sometimes also demarcating subdivisions of the court, primarily for the purpose of designating the respective area(s) of the court in which game play is either permissible or must be avoided. A target game is one that is played by one or more players with a target as well as at least one ball, arrow, dart or other projectile that is propelled at the target, in which points are generally awarded during play depending upon the exact location within (or outside of) the target that is either struck by the projectile or through which the projectile passes.

The present invention is a simple yet novel combination of both of these game types, which may be implemented either in physical (i.e., mechanical, real-world) formats, or in corresponding electronic or "virtual" formats, and in which the target appears to "move," i.e., one or more of a plurality of different targets are successively designated, each for a specified time interval, and a player must propel an object at one of the designated targets during the time interval in which that target is (or those targets are) being designated. The invention extends not only to the games themselves in their various forms, but also to a target apparatus for use with the physical implementations of the games or with additional and/or different target games that may be devised by others in the future.

SUMMARY OF THE INVENTION

In accordance with the invention, a game apparatus for playing physical implementations of the new target games includes a target apparatus comprising a frame, preferably rectangular in shape, the interior of which defines a target area. The target apparatus also comprises means for subdividing the target area into a plurality of target zones, means for selective visual differentiation of each one of the target zones, and means for detecting the repetitive transverse passage through the target area, from one side of the target apparatus to the other, of at least one moving object or projectile. For each passage of the object through the target area, the detection means is capable of determining, and has output means for generating signals specifying, the direction in which each object passes through the target area and the location of the particular target zone through which each object passes. In its physical implementations, the game apparatus also includes means to enable each player of the game to propel one of the objects towards the frame and through the target area. Preferably, the propulsion means comprises a conventional racquet or paddle, although it is to be understood that the propulsion means could conceivably comprise other devices as well.

The game apparatus further includes a programmable electronic digital computer which, under software control, selectively activates the visual differentiation means so as to visually designate one or more of the target zones, preferably in a predetermined sequence, and each preferably for a predetermined period of time. After each player propels an object toward the frame, the computer also determines, for each passage of an object through the target area from one side of the target apparatus to the other, the location at which that object has passed through the target area, including whether or not that object has passed through one of the target zones that was visually designated at the time of such passage; points are awarded by the computer to each player based thereon in accordance with predetermined rules programmed therein. The computer also maintains a score for each player, which is a cumulative total of the points earned by each player throughout the course of a game. The computer also depicts each player's score on a display. Optionally, in its physical implementations the game apparatus may also include a game court on which the new target games can be played.

In accordance with the invention, the game apparatus may alternatively comprise a programmable electronic digital computer on which the target games and the play thereof, including at least the target apparatus and all the features and functions thereof, can be simulated. Such electronic implementations of the target games of the invention could optionally include computerized simulations of other parts of the game apparatus, including the game court, and/or the propulsion means, and/or the moving object itself, and they could even include computerized simulations of the opposing player(s). The computer would in these cases also be provided with appropriate input means to receive information from which the speed and trajectory of the moving object can be deduced and/or simulated, thereby allowing a single player to engage in one of the target games of the invention solely by interacting with the computer, either in a "video game" setting or in a "virtual reality" setting.

BRIEF DESCRIPTION OF THE DRAWINGS

The objects, features and advantages of the present invention will become more apparent from the detailed description of the preferred embodiments thereof, when read in conjunction with the accompanying drawings, wherein.

DETAILED DESCRIPTION OF THE PREFERRED EMBODIMENTS

Figure 1:
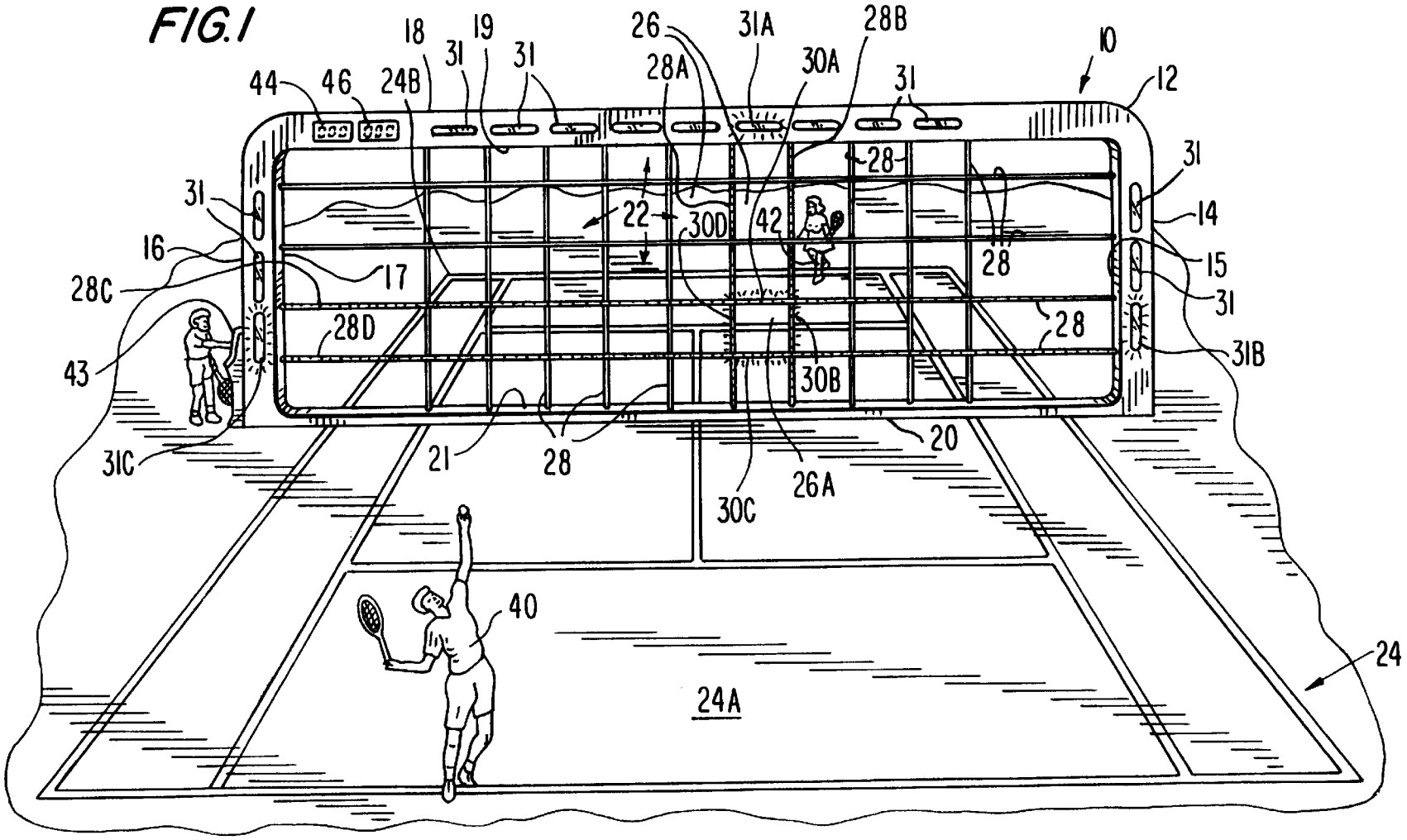
FIG. 1 is a front perspective view of the target apparatus of the present invention, for use in playing the physical target games of the present invention, showing the targets, the players and the court.
Figure 2:
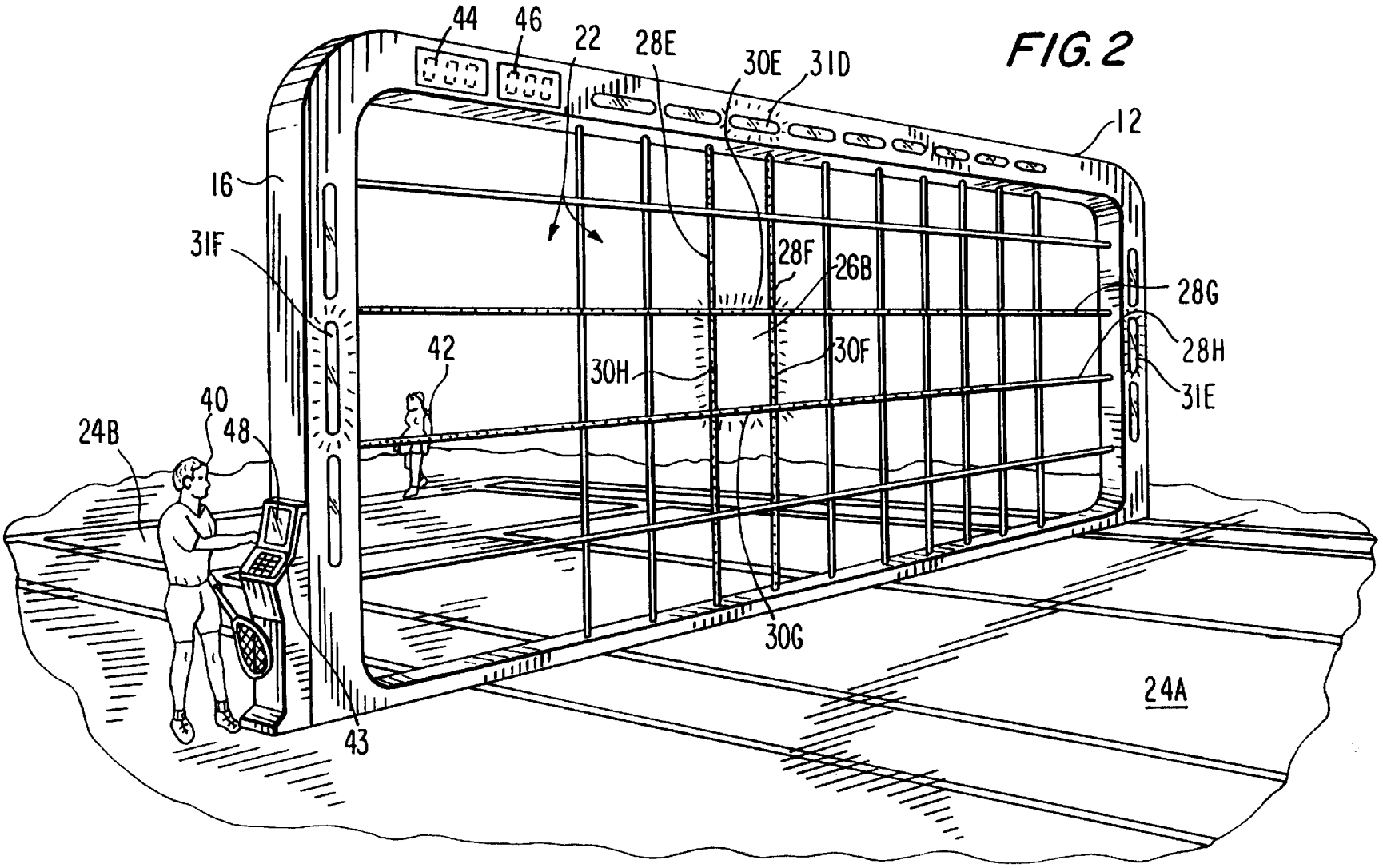
FIG. 2 is an enlarged perspective view of the apparatus shown in FIG. 1, viewed from a different angle.

With reference now in more detail to the drawings, and in particular to FIGS. 1 and 2 thereof, a target apparatus for playing physical implementations of the target games of the present invention is generally designated 10. Apparatus 10 includes a frame 12 that is preferably substantially rectangular in shape. Frame 12 has two parallel opposing vertical wall elements 14, 16, and two parallel opposing horizontal wall elements 18, 20, which are joined at their respective ends to define a substantially rectangular target area within the frame, generally designated 22 and circumscribed by the interior surfaces 15, 17, 19 and 21 of wall elements 14, 16, 18 and 20, respectively.

Optionally, but preferably, frame 12 can be erected on or near some sort of game court (generally designated 24 in FIG. 1), although it is to be understood that the invention extends to physical implementations of the new target games that do not include such a game court. While a conventional tennis court configuration is most preferred, the game court need not necessarily correspond exactly with that configuration. For example, it may differ in size and/or composition (e.g., it may have a wooden floor like a basketball court); furthermore, it may be located indoors or outdoors.

As shown illustratively in FIG. 1, frame 12 most preferably straddles a conventional tennis court at the center of the court, and extends across the entire width of the court; in other words, it is positioned exactly where the net would otherwise be, and it divides game court 24 into two substantially equal half-court portions 24A, 24B. More preferably, the lower horizontal wall element 20 of frame 12 is mounted so that it rests within a previously formed groove or depression (not shown) in court 24, such that the upper surface 21 of wall element 20 is flush with the surface of court 24 (i.e., nearly all of wall element 20 is countersunk and hidden below court level.) However, the rest of the frame 12 is visible from either side, i.e., from half-court 24A and from half-court 24B. (The drawings do not show any supporting cables or other physical structures which might be necessary either to support the frame, or to prevent it from being knocked down.)

The apparatus 10 also includes means for subdividing the target area 22 of frame 12 into a plurality of smaller, preferably rectangular, and more preferably substantially square, target zones 26. In the physical implementations of the games of the invention, the subdividing means preferably comprises a plurality of bars 28 made of steel, aluminum, or plastic, that are affixed at their ends to the wall elements of frame 12; more preferably, the bars 28 are arranged into an intersecting grid pattern such as that shown illustratively in FIG. 1, wherein target area 22 may be subdivided into several vertical columns and several horizontal rows. Most preferably, the bars 28 subdivide the target area 22 into nine vertical columns and three horizontal rows, yielding a total of twenty-seven different target zones 26 (only some of which are designated with numerals in FIG. 1).

The apparatus 10 further includes means for selective visual differentiation of at least one of the target zones 26: preferably, the visual differentiation means comprises electrical wiring (not shown) running within bars 28, as well as lighting elements 30 carried on the exterior surfaces of, or supported by, bars 28 (the lighting elements 30 are not shown separately from the bars 28 in FIGS. 1 and 2); such lighting elements may be protected by a coating or layer of clear plastic (not shown). Alternatively, bars 28 may incorporate internally, or may themselves actually also comprise, the lighting elements 30 (e.g., bars 28 may be hollow and made of a transparent material, and may contain incandescent or fluorescent filaments, or neon or other inert gas(es), in accordance with known technology). In any case, lighting elements 30 are connected through the wiring to a selective activation means (not shown).

Selective activation of different combinations of lighting elements 30 results in selective visual designation of one or more of the target zones 26; preferably, this visual designation continues for a predetermined period of time, after which a different combination of lighting elements 30 is activated so as to designate visually a different one (or more) of the target zones 26, preferably for the same predetermined interval of time, and this visual designation is repeated serially with different target zones 26, either in random fashion or, more preferably, in a predetermined sequence that will be described hereinafter. Most preferably, only one target zone 26 will be visually designated at any one given time during the course of play of any one of the target games of the invention, although it will be understood that alternate target games can be devised in which more than one of the target zones would be visually designated simultaneously, e.g., two different target zones would be visually designated during each predetermined interval of time.

Preferably, as shown in FIGS. 1 or 2, when a particular target zone 26A or 26B, respectively, is to be visually designated, lighting elements 30A, 30B, 30C and 30D (in FIG. 1) or lighting elements 30E, 30F, 30G and 30H (in FIG. 2) are illuminated (as indicated by the enhancements shown in those drawings). More preferably, for each target zone 26A or 26B being visually designated, the lighting elements 30 bordering the entire row (the "targeted row") and the entire column (the "targeted column") in which that particular target zone is situated are illuminated as well, as depicted illustratively in FIG. 1 by the cross-hatching in the bars 28A, 28B, 28C and 28D, and in FIG. 2 (where this feature is perhaps shown best) by the cross-hatching in the bars 28E, 28F, 28G and 28H.

Although FIGS. 1 and 2 depict lighting elements 30 only from the perspective of half-court 24A, it is to be understood that the lighting elements 30 are to be constructed so that they can also be seen from half-court 24B, or that additional lighting elements 30 will be carried on the sides of bars 28 that face half-court 24B, such that the visual designation of one or more of the target zones is visible from both sides of the frame 12 simultaneously.

The apparatus 10 optionally also includes additional exterior lighting elements 31, most preferably mounted in the wall elements 14, 16 and 18 of frame 12. As shown illustratively in FIGS. 1 and 2, one of these exterior lighting elements 31 will be placed above each of the columns, and one at either side of each of the rows, of the target area 22. When the targeted row or targeted column is illuminated by lighting elements 30, the corresponding exterior lighting elements 31 (i.e., exterior lighting elements 31A, 31B and 31C in FIG. 1, and exterior lighting elements 31D, 31E and 31F in FIG. 2) will also be illuminated, as indicated by the enhancements in these drawings. This feature will help the players (as well as observers) to distinguish at any given moment the targeted row and targeted column from the rows and columns that are not targeted.

Although FIGS. 1 and 2 depict exterior lighting elements 31 only from the perspective of half-court 24A, it is to be understood that additional exterior lighting elements 31 (not shown) will be mounted in the wall elements 14, 16 and 18 of frame 12 on the side of frame 12 that faces half-court 24B, or that the exterior lighting elements 31 shown in the drawings are to be constructed so that they can also be seen from half-court 24B, such that this feature will assist players and observers situated on either side of frame 12.

Figure 5:
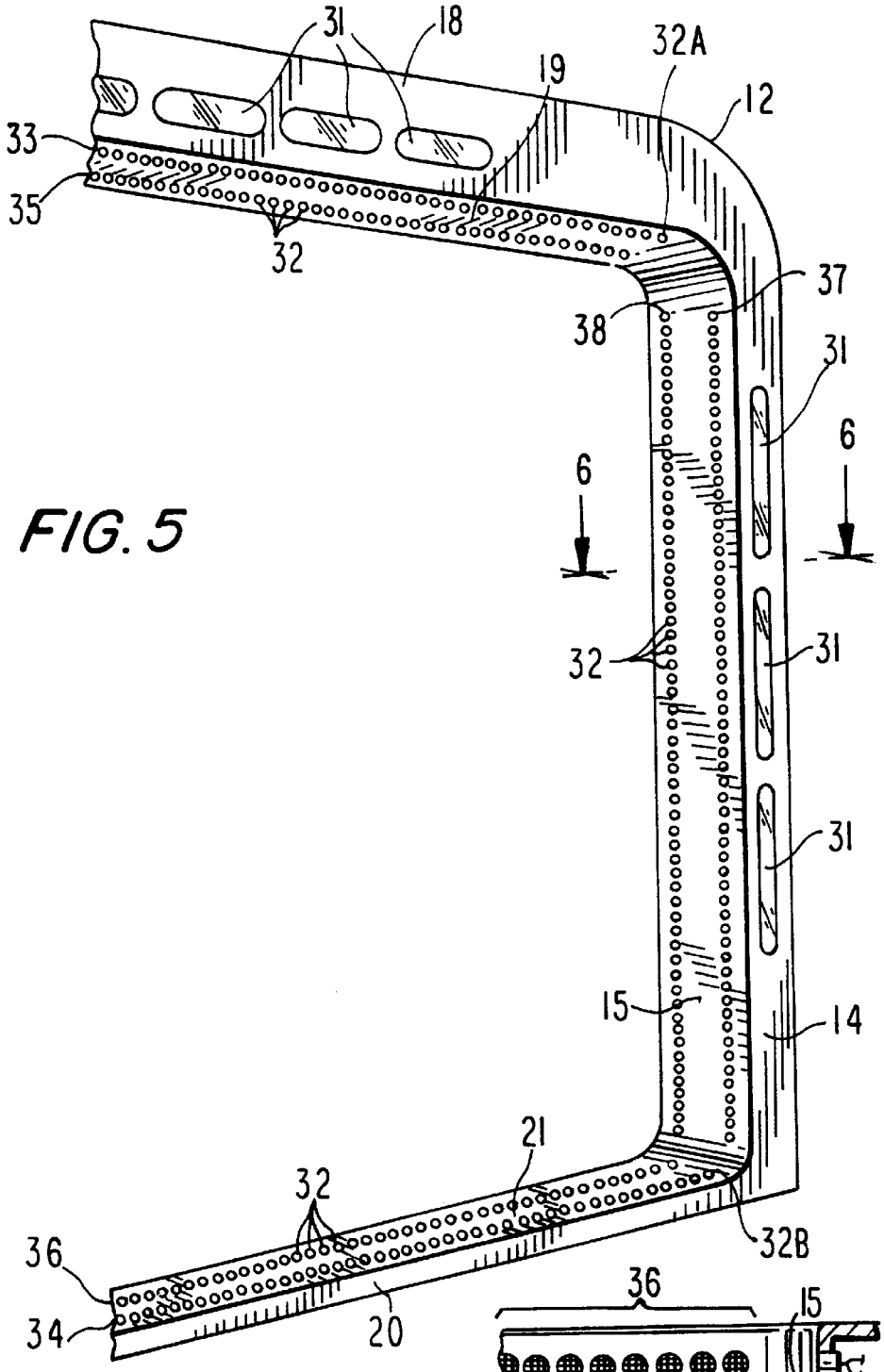
FIG. 5 is a further enlarged side perspective view, partially broken away, of the apparatus shown in FIGS. 1 and 2, showing the interior and some of the features thereof in further detail.
Figure 6:
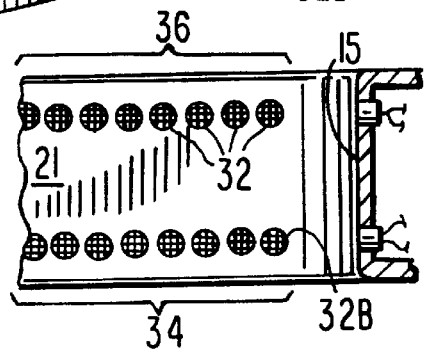
FIG. 6 is a cross-sectional view, taken substantially along lines 6—6 of FIG. 5.

Referring now to FIGS. 5 and 6 in addition to the aforementioned FIGS. 1 and 2, the apparatus 10 also includes means for detection of the passage of at least one moving object or projectile (not shown) through the frame from one side of apparatus 10 to the other (e.g., from one player's side of court 24 to another player's side in the illustrative view of FIG. 1). The detection means preferably comprises a plurality of light-emitting detection devices 32 (each most preferably utilizing a laser as the light source) connected by appropriate circuitry (not shown) into an arrangement akin to an array of "electric eyes" (this type of detection technology is commonly used in security systems and is readily available in the marketplace, U.S. Pat. Nos. 3,816,745, 3,852,592, 4,742,337, 4,794,248, 4,894,952, 4,910,464, 4,914,859, 4,976,337 and 5,149,921 being representative of the state of this art).

More preferably, two parallel rows of such detection devices (the rows are designated in FIGS. 5 and 6 with the numerals 33, 34, 35, 36, 37 and 38) are installed in each of the respective interior surfaces 15, 19 and 21 of wall elements 14, 18 and 20 of frame 12, with two similar rows of such devices also installed in the interior surface 17 of wall element 16 (not shown), such that the light-emitting detection devices are aligned with corresponding reflective elements installed in the interior surface of the opposite wall element, in facing pairs. For example, as shown illustratively in FIG. 5 (from which the bars 28 and the lighting elements 30 have been omitted for ease of understanding), the row 33 which is installed in the interior surface 19 of wall element 18 is positioned exactly opposite the row 34 which is installed in the interior surface 21 of wall element 20 (such that the detection device 32A and its counterpart reflective element 32B, for example, form an aligned pair), and the same is true for rows 35 and 36; similarly, rows 37 and 38 which are installed in the interior surface 15 of wall element 14 are respectively positioned exactly opposite the two rows (not shown) installed in the interior surface 17 of wall element 16 (not shown in FIG. 5).

When an object such as a ball passes from either direction through the target area 22 of frame 12, one or more of the devices 32 is activated, triggering output signals that indicate not only the direction of travel the ball (it will be apparent to those of ordinary skill that the rows of devices 32 that are activated first are the ones on the side of the apparatus 10 from which the ball was propelled or hit), but also the vertical position (i.e., the height) and the horizontal position at which the ball passes through the target area 22.

It should be noted that reflecting light is certainly not the only way to determine where in three-dimensional space an object is. The detection means may instead employ sound waves, or utilize other portions of the electromagnetic spectrum, such as radio waves. These technologies may or may not be used in conjunction with light waves. However, if laser light is used, then in order to avoid possible damage to the eyes of the player(s) and any spectators, shielding devices may optionally be incorporated into the frame 12 so that no direct view of the light sources in detection devices 32 will be possible from most angles.

In the preferred embodiments of the physical implementations of the target games of the present invention, there will be at least two players 40, 42 (as shown illustratively in FIGS. 1 and 2), with at least one player being positioned on each half-court 24A, 24B (i.e., on each side of frame 12) in a manner similar to a conventional game of tennis, and with each player repetitively propelling an object (preferably a ball) toward the frame 12 and through the target area 22 toward the other player(s), resulting in an alternating exchange (as in conventional lawn tennis). It is to be understood, however, that other embodiments are possible in which only one player participates in the game (this might be considered analogous to "target practice"), and in those cases half-court 24B could be omitted, and/or the frame 12 could optionally be situated in front of a wall (not shown), such that each time a ball is propelled by the player through the target area 22, the ball will strike the wall and then begin moving in the reverse direction, towards the player, who would attempt to meet it and propel it towards the frame 12 once again.

The apparatus 10 further includes a programmable electronic digital computer 43, shown illustratively in schematic form in FIGS. 1 and 2 as being attached to or formed integrally with the wall element 16 of frame 12. The computer includes digital storage means, input means comprising means for receiving and processing input signals received from the detection means, and output means comprising at least one display (none of these means are shown in the drawings). The output means further comprises means (not shown) for generating and transmitting output signals for selective activation of the visual differentiation means so as to visually designate at least one of the target zones 26.

The computer also includes digital programming means (i.e., software) capable of controlling the selective activation means in order to designate visually at least one of the target zones 26 for a predetermined period of time, and to vary the location of the visually designated target zone(s) by visually designating different target zones in sequence in accordance with a set of predetermined rules stored in the storage means. The software is also capable of repetitively comparing the output signals controlling the selective activation means with the input signals received from the detection means so as to determine, for each transverse passage of an object through the target area 22, whether or not the object passes through at least one of the target zones that was visually designated at the time of such passage.

The software is further capable of tallying the successive passages of at least one object through the target area 22 from one side of the frame 12 to the other in at least one direction, and of computing a score for each player based thereon in accordance with a set of predetermined rules stored in the storage means, the score being primarily based upon the respective locations of the target zones 26 through which the object successively passes.

Finally, the software is also capable of depicting the score for each player on at least one display; preferably, as shown illustratively in FIGS. 1 and 2, apparatus 10 includes a plurality of such displays, including two different conventional electronic numeric displays 44, 46 (as well as an alphanumeric monitor 48) on which the score of each player is or can be displayed. Displays 44 and 46 can, however, in accordance with known technology, be free-standing rather than incorporated into the frame in the manner shown in the drawings, or such free-standing displays can be utilized in conjunction with those shown in the drawings.

In operation, and using the information gathered from the detection means, the computer will, under software control, be able to recognize the exact location at which the ball or other object passes through frame 12. If an object larger or smaller than a predetermined size triggers the detection means, then the computer can be programmed to award no points. For each passage of an object through the frame 12, points are awarded by the computer based on where, and from which direction, a ball of acceptable size passes through the target area 22. The computer will also be programmed to keep a running tally of the points awarded to each player.

It will be apparent from the foregoing that the objective in all of the target games disclosed herein is to hit a ball "through" a specific visually designated (i.e., highlighted) target zone (illuminated or outlined by lighting elements 30) during a specific interval of time, preferably no more than five (5) seconds. The highlighted target zone (also referred to hereinafter as the "designated rectangle") changes after each such time interval, preferably in a "continuous W" pattern which will be described in more detail below.

The physical implementations of the target games disclosed herein cannot be played without the target apparatus 10. However, it is conceivable that the target apparatus 10 or the frame 12 could be used for some purpose other than playing games.

The rules of play for three different kinds of preferred target games (all of the preferred target games are referred to collectively hereinafter as "TARGET TENNIS") will now be specified, the details of which will better explain the purpose and operation of the target apparatus 10. It is to be understood, however, that these rules are illustrative only, and that changes in basic parameters such as the duration of each one of these games, the number of players, the number of seconds that a particular designated rectangle is highlighted, and/or the relative dimensions of the rows and columns, can be varied, and that additional rules, such as a rule specifying a distance from the frame beyond which the players must conduct play, can be incorporated.

In each of the following types of TARGET TENNIS, players will use a standard tennis ball and conventional tennis rackets. (The dimensions of these may be found in the Sports Rules Encyclopedia compiled and edited by Jess R. White [1961] and published by The National Press, Palo Alto, Calif.) Every five seconds, a different targeted row and a different targeted column will be outlined by lighting elements 30 or by other means, thereby highlighting the designated rectangle where they intersect. If a player hits a ball through the targeted row (but not through the targeted column) during those five seconds, one point will be awarded. If a player hits a ball through the targeted column (but not through the targeted row) two points will be awarded. If a player hits the ball through both the targeted row and the targeted column—that is, if the ball passes through the designated rectangle—three points will be awarded. If a player hits the ball through nine designated rectangles in a consecutive fashion, the point total for those nine executions will be doubled. Thus, instead of receiving twenty-seven points for those nine hits, a player would receive fifty-four points. If such a nine-hit "streak" of designated rectangles continues, that player would continue to score six points (instead of three points) for each additional successful hit through a designated rectangle. A nine-hit streak may begin with any designated rectangle. Further rules about streaks are stated below.

The five-second time interval just discussed is to be measured from the moment the ball passes through the frame 12. Thus, the designated rectangle (and the targeted row and targeted column) will change every five seconds or sooner, depending on when the ball passes through the frame. Thus, the designated rectangle and the targeted row and targeted column change a maximum of every five seconds.

As soon as the ball passes through the frame, the "five-second clock" begins for the following designated rectangle. If no ball passes through the frame during that time, the designated rectangle (and the targeted row and targeted column) will continue to change every five seconds.

In two of the preferred TARGET TENNIS games—SINGLES and DOUBLES TARGET TENNIS—one point will be deducted whenever a player does not hit the ball through the frame during the five second time interval. This penalty is necessary because, without it, a player with a substantial lead could slow play, thus making it more difficult for the opponent(s) to catch up.

Figure 4:
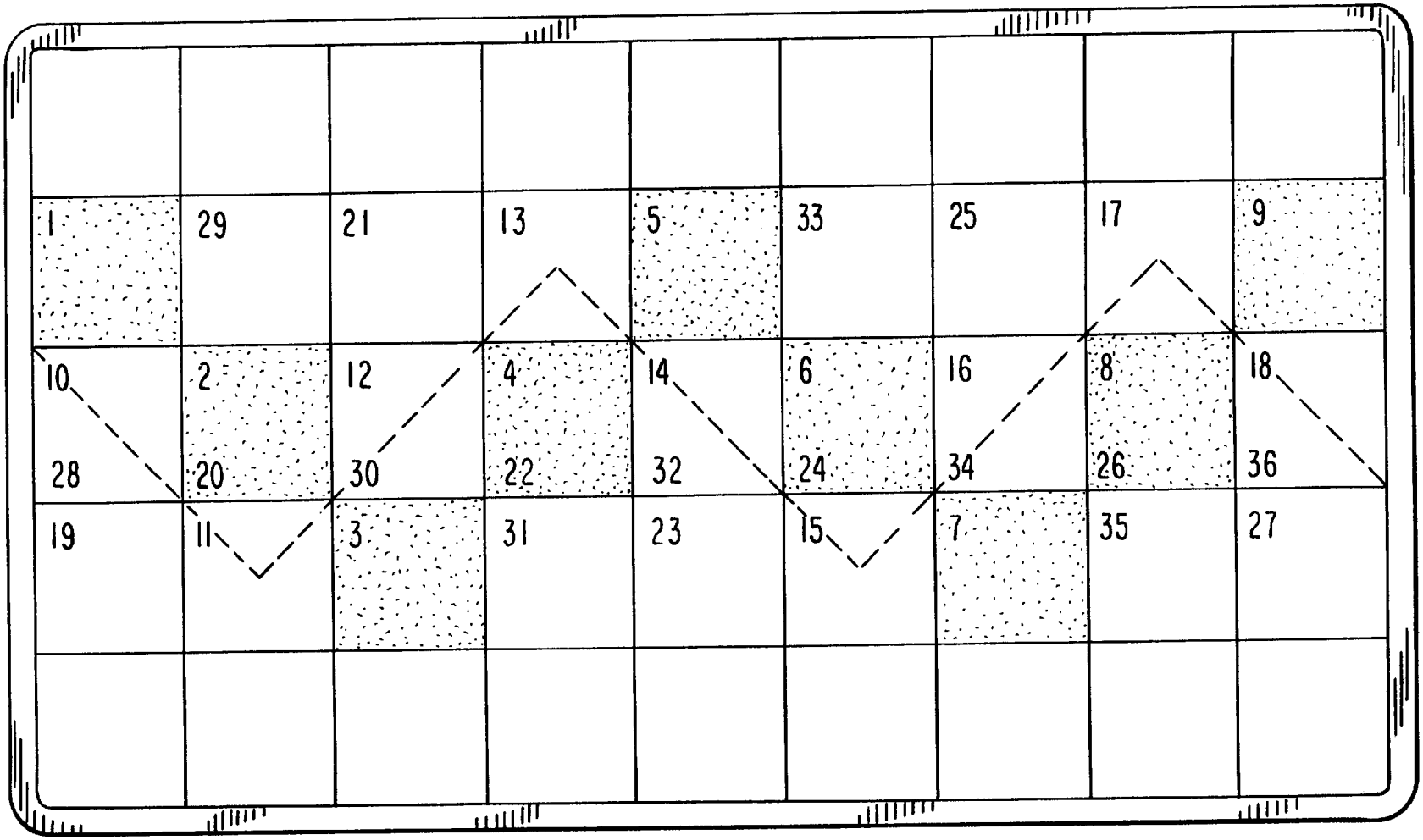
FIG. 4 is a schematic representation of the apparatus shown in FIG. 1, indicating a preferred sequence in accordance with which the location of the target changes during a game.

Referring now to FIG. 4 in addition to the previously-mentioned FIGS. 1, 2, 5 and 6, in all varieties of TARGET TENNIS the target will appear to "move," i.e., the location of the designated rectangle will change, preferably in a predetermined pattern as mentioned hereinabove. Most preferably, that pattern is the one shown schematically by the sequence of numerals (1–36) in FIG. 4. Using this pattern, the position of the designated rectangle will appear to shift or "move" in an undulating fashion that is visually reminiscent of the letter "W" (as indicated by the shading and also by the dashed lines in FIG. 4); therefore, this pattern is referred to herein as a "continuous W" pattern. Thus, in any sequence of thirty-six (36) five-second time intervals, each of the nine target zones in the top row will become the designated rectangle once, each of the nine target zones in the bottom row will become the designated rectangle once, and each of the nine target zones in the middle row will become the designated rectangle twice. The direction of the "continuous W" pattern (either left to right or right to left) will depend on the side of the frame (i.e., the half-court) from which it is viewed.

In all varieties of TARGET TENNIS, a ball may be caught or stopped or bounced. In two of the games—DOUBLES TARGET TENNIS and TEAM TARGET TENNIS—the ball may also be thrown by one player to another, provided that both of those players are on the same side of the frame. However, the ball may not be thrown through the frame; it may be thrown only if it remains on the same side of the frame. A likely situation in which that may happen is discussed below. Players may wear gloves.

In games other than the particular descriptions of TARGET TENNIS specified herein, different targeting patterns, including random patterns, may be employed. Visual designation periods other than five seconds may also be employed. Thus, the present invention may be used for games other than those described herein.

With certain exceptions pertaining to streaks, SINGLES TARGET TENNIS and DOUBLES TARGET TENNIS are thirty minute games; and TEAM TARGET TENNIS is a sixty minute game.

In SINGLES TARGET TENNIS, there are two opposing players, one on each side of the frame. They play continuously, and at the end of thirty minutes, the player with the higher number of points wins. DOUBLES TARGET TENNIS is basically the same game, but played with two players on each side. At the end of thirty minutes, the doubles team with the higher point total wins. However, in both SINGLES and DOUBLES TARGET TENNIS, as well as in TEAM TARGET TENNIS, the game may not be terminated if a streak has begun. That is, a game may not end if a singles player (or a doubles team) has just hit the ball through two or more designated rectangles in consecutive fashion. If that occurs, the game would continue (beyond thirty or sixty minutes) until the streak comes to an end.

In DOUBLES TARGET TENNIS, a streak may be continued (maintained) by either player on the doubles team. A successful streak in DOUBLES TARGET TENNIS may be more likely than in SINGLES TARGET TENNIS, because if the targeted column is one of the two right-most columns of target area 22 (viewed as in FIG. 1) and if the ball is hit through a designated rectangle within that column, then the ball (after it is returned by the opposing team) must be hit through a designated rectangle in one of the two left-most columns of target area 22 in order to continue the streak. While this may be difficult for some SINGLES players, a DOUBLES team can accomplish it more easily by quickly throwing or bouncing the ball from player to player to position it for the next hit.

In these target games, it will be considered very poor sportsmanship for a player to intentionally aim a hit for the purpose of thwarting or hindering a streak that the opposing player or team has begun. However, no penalties will be imposed for doing so. (Unlike conventional lawn tennis, in SINGLES and DOUBLES TARGET TENNIS the object of the game is not to force the opponent miss the ball—although the goal is to score more points than one's opponent. But this must be done in a courteous way. This means that players should always aim for the targeted column or targeted row or, of course, the designated rectangle.)

Undoubtedly, some players may become accustomed to viewing the movement of the targets from left to right or from right to left. In order to minimize this problem, an additional rule may be included, specifying that opposing players must switch sides during the course of a game. Additional rules may also be included to specify how, when and how often a player or team may call a "time out."

TEAM TARGET TENNIS is fundamentally different from the two games described above. There are two teams of four players. These teams do not oppose each other at the same time. Instead, one team takes the court at a time; half of the team (two players) plays on one side of the frame, and the other half of the team plays on the other side of the frame. The entire team tries to score as many points as possible during a ten-minute play segment. At the end of ten minutes, the opposing four-person team takes the court and does the same. Play takes place in alternating in ten-minute segments. Thus, each team will play three ten-minute segments in a sixty-minute game. At the end of sixty minutes of play, the team with the highest number of points wins.

In TEAM TARGET TENNIS, a streak may be continued (maintained) by any player on the team. In fact, a streak in TEAM TARGET TENNIS cannot be maintained solely by an individual player because the players on both sides of the frame are on the same team, and thus, a streak in TEAM TARGET TENNIS is always a volley. Therefore a streak may be more easily foreseen in this game than in SINGLES or DOUBLES TARGET TENNIS. (A streak in TEAM TARGET TENNIS means that the ball must be hit through nine or more consecutive designated rectangles, with the ball passing through the target area 22 from the alternate direction on each hit. In SINGLES or DOUBLES TARGET TENNIS, a streak means that a singles player or doubles team actually must hit the ball through every second (i.e., every other) designated rectangle, and must do so nine or more times consecutively, since the return ball [from the opposing side] is not considered part of the streak.)

In TEAM TARGET TENNIS, an ongoing streak does not extend the play segment, except during the final play segment for each side. In other words, even if a streak is occurring, play is suspended at the end of the ten-minute segment if it is the first or second ten-minute segment for a team. However, if it is the last ten-minute segment for a team, and a streak has begun, play would continue beyond that ten-minute segment until the streak ends.

If a streak is occurring at the end of a first or a second ten-minute play segment in TEAM TARGET TENNIS, rules could be devised so that the streak could be continued in the following play segment for that team. For example, if the first play segment ends in the middle of a streak, the streak could continue the next time the team takes the court—which would be its second play segment.

The intentional slowing down of play should not be a problem in TEAM TARGET TENNIS because players will have no incentive to do so. Therefore, penalties will not be specified herein for wasting time in this game.

Additional rules may be specified for TEAM TARGET TENNIS including how, when or how often a team may call a "time out," how much time may transpire between the ten-minute play segments, and the procedure for substitution of players. One option for the latter may be that if a player has to drop out, the team would simply continue to play without that player (and be at a disadvantage). Regarding the former, it is preferred that there be no "times out" during a ten-minute play segment, but that "times out" may be called between play segments.

The following optional rule will apply to TEAM TARGET TENNIS only: Players would have to stand a certain minimum distance from the frame while hitting the ball; a team would be penalized one point each time a player crosses a certain line on the game court (not shown). The points may be deducted automatically: two light-emitting detection devices (not shown), one positioned at knee-height and another at ankle-height, would be placed along side both sides of the game court, and if a player moving towards the frame crosses that line, both devices would be triggered simultaneously, as a result of which the computer would deduct one point from that team's score.

Preferably, the frame 12 will be twelve to fifteen feet high; also, the bars 28 comprising the horizontal boundary between the bottom row and the middle row of target zones 26 will preferably be situated no more than six feet above the level of the game court, and the columns will extend the entire height of the frame. Therefore, a player may still earn two points by hitting the ball through the designated column, even if the ball passes through the target area 22 either above the top row of target zones or below the bottom row of target zones. The relative dimensions of the rows and columns will be left to the discretion of those skilled in the art, although it is preferred that the height of the rows be the same as the width of the columns, such that the target zones 26, including the designated rectangle, are actually squares.

It is intended that the game apparatus of the present invention may be used by the public in both indoor and outdoor settings. Therefore, its operation must be as automated as possible. Provision can be made for billing players for court time used, e.g., a credit card insertion slot (not shown) can be designed into the frame 12, adjacent the computer 43. A player on a public court could insert his credit card into the frame and be billed for a fixed amount of time. A telephone line (not shown) can be connected to the computer 43 for this purpose.

The present invention is believed to be the first proposed use of technology in a target game for the purpose of determining the location of an object in three-dimensional space.

As mentioned above, corresponding electronic implementations of the new target games, including electronic implementations of TARGET TENNIS, for use on programmable digital computers and other microprocessor-based electronic devices, are within the scope of the present invention. In several preferred embodiments of such electronic implementations, the players might wear "virtual reality" helmets or goggles, and would hit a special ball that could continuously transmit signals to the computer specifying its position and speed; moreover, the computer would simulate the frame, as well as the targeted row, the targeted column, and the designated rectangle therein (and, optionally, the game court also), so that the players would see them only through the goggles or only when wearing the helmet. In yet other preferred embodiments, an entire target game might be played in virtual reality, with even the ball (and possibly even the opposing player(s)) being simulated by the computer (thus, in some of these embodiments, a "real" singles player or doubles team would play against the computer).

Each of the foregoing preferred electronic embodiments could also be modified to yield still other electronic embodiments in which the physical implementations of the "target practice" versions of the present invention (described hereinabove) would be simulated, either partially or completely, by the computer. Moreover, instead of virtual reality helmets or goggles, a new technology known as virtual retinal display might be employed, thereby possibly allowing a player to simultaneously see both the "real" world (e.g., a physical game court and the opposing player (s)) and a "virtual" world (e.g., the ball, the frame, the targeted row and targeted column, and the designated rectangle), using a small device that could be clipped onto the player's eyeglasses (this technology is discussed in "For Your Eyes Only," Discover, July 1998, page 93).

Figure 3:
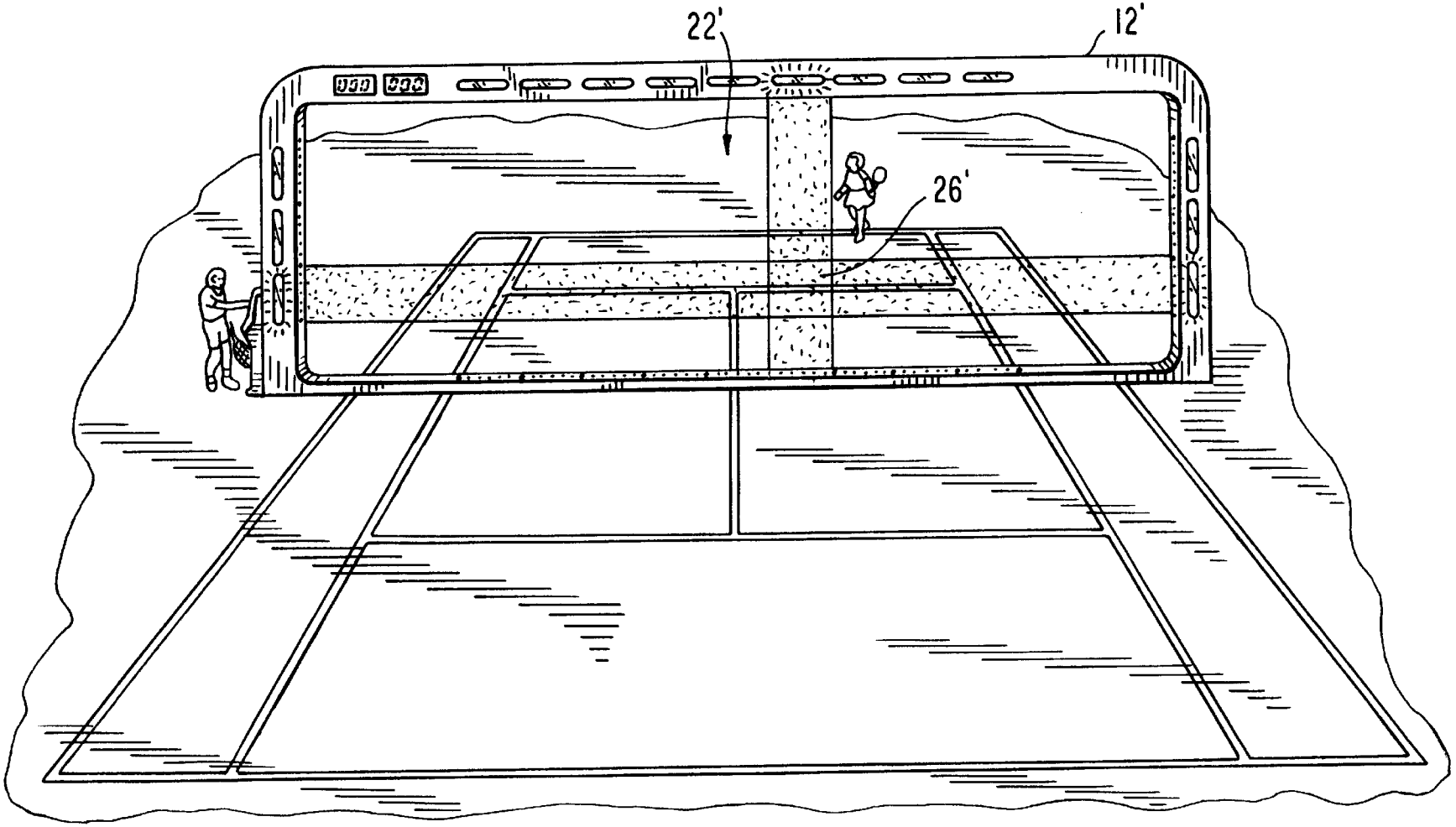
FIG. 3 is a perspective view of an electronic simulation of the apparatus shown in FIG. 1, for use in playing the electronic target games of the present invention.

In accordance with the electronic implementations of the invention described above, and referring now to FIG. 3 in addition to the aforementioned FIGS. 1–2 and 4–6, an electronic simulation of the target apparatus of the present invention, including a simulated frame 12' and a target area 22', is shown illustratively therein. The subdividing means for the electronic versions of the frame need not take physical form; thus, no bars are necessary. Instead, the targeted row and targeted column can be made to appear in a shaded color, and the intersection of these shaded regions will create the appearance of a rectangle (the designated rectangle 26' as shown in FIG. 3), which can be made to appear in yet a different shaded color. (Although it would be preferable to use such shading also in the physical implementations of these games, such a shading effect is not possible to create in the "real" world, even with appropriate light sources, absent the simultaneous use of smoke or fog to provide the requisite contrast.)

Alternatively, in another electronic simulation, all of the target zones (or the entire target area 22 ) can be made to appear in one shaded color, except for those located within the targeted row and targeted column, which can be made to appear in a different shaded color. Other ways in which to distinguish the targeted row and targeted column from the rows and columns that are not targeted will be apparent to those skilled in the computer simulation art. In any event, it is believed that it is well within the skill of the computer simulation and/or computer programming arts to implement electronically the various computer embodiments of the present invention.

It will be understood that in these electronic target games the location of the designated rectangle will still change periodically, preferably in a predetermined sequence, and most preferably in the "continuous W" pattern described hereinabove. However, the designated rectangle will not be suspended or attached to anything; instead, it will literally appear to "float" in mid-air, and its boundaries will be distinguished only by colors and/or shading.

In the event that the physical TARGET TENNIS games ultimately achieve the status of an amateur or even professional sport, played in arenas, it is plausible that observers who are not in the vicinity of the actual device (i.e., television viewers) will be unable to distinguish the targeted rows and columns from the rows and columns that are not targeted as easily as spectators seated in the arena at courtside. To remedy this problem, the computer could also be programmed to send a signal directly to the television studio containing enhanced images that would superimpose colored lines around the target zones, or would superimpose a shaded area over them, as in the electronic versions of the games described hereinabove. These superimposed patterns would be coordinated exactly with the changing location of the designated rectangle, and the television audience would thus see a computer-enhanced version of the predetermined (e.g., the "continuous W") targeting pattern.

While there has been described what are at present considered to be the preferred embodiments of the present invention, it will be apparent to those skilled in the art that the embodiments described herein are by way of illustration and not of limitation, and that various changes and modifications may be made therein without departing from the true spirit and scope of the present invention, as set forth in the appended claims.

What is claimed is:

1. A target apparatus comprising:

(a) a frame comprised of two pairs of opposing wall elements, the wall elements of the first said pair being oriented in parallel spaced relation with one another and the wall elements of the second said pair being oriented in parallel spaced relation with one another, each wall element of the second said pair being oriented perpendicularly to the wall elements of the first said pair to define a target area within said frame, (b) means for physically subdividing said target area into a plurality of target zones, (c) means for enabling selective visual differentiation by a user of said apparatus of each one of said target zones from the remainder of said target zones, said visual differentiation enabling means comprising selectively illuminateable regions of said subdividing means, (d) means for detecting the repetitive transverse passage through said target area from one side of said frame to the other of at least one moving object, for each such passage said detection means being capable of determining, and having output means for generating signals specifying, the direction in which said at least one object passes through said target area and the location of the particular target zone through which said at least one object passes, and (e) a programmable digital electronic apparatus comprising (i) digital storage means, (ii) output means comprising at least one display and further comprising means for selectively activating said visual differentiation enabling means so as to visually designate to said user at least one of said target zones, (iii) input means comprising means for receiving and processing signals from said detection means, and (iv) digital programming means capable of controlling said selective activation means in order to designate visually at least one of said target zones for a predetermined period of time and to vary the location of said at least one visually designated target zone, said digital programming means being further capable of (1) repetitively comparing the signals controlling said selective activation means with the signals received from said detection means so as to determine for each such passage whether or not said at least one object passes through said target area within said at least one visually designated target zone, (2) tallying the successive passages of said at least one object through the target area from one side of said frame to the other in at least one direction, and computing at least one score based thereon in accordance with a set of predetermined rules stored in said storage means, said at least one score being based primarily upon the respective locations of the target zones through which said at least one object successively passes, and (3) depicting said at least one score on said at least one display.

2. An apparatus for play of a target game by at least one player, said apparatus comprising:

(a) a frame comprised of two pairs of opposing wall elements, the wall elements of the first said pair being oriented in parallel spaced relation with one another and the wall elements of the second said pair being oriented in parallel spaced relation with one another, each wall element of the second said pair being oriented perpendicularly to the wall elements of the first said pair to define a target area within said frame, (b) means for physically subdividing said target area into a plurality of target zones, (c) means for enabling selective visual differentiation by said at least one player of each one of said target zones from the remainder of said target zones, said visual differentiation enabling means comprising selectively illuminateable regions of said subdividing means, (d) means for detecting the repetitive transverse passage through said target area from one side of said frame to the other of at least one moving object, for each such passage said detection means being capable of determining, and having output means for generating signals specifying, the direction in which said at least one object passes through said target area and the location of the particular target zone through which said at least one object passes, (e) means to enable said at least one player to propel said at least one object toward said frame in a repetitive fashion, and (f) a programmable digital electronic apparatus comprising (i) digital storage means, (ii) output means comprising at least one display and further comprising means for selectively activating said visual differentiation enabling means so as to visually designate to said at least one player at least one of said target zones, (iii) input means comprising means for receiving and processing signals from said detection means, and (iv) digital programming means capable of controlling said selective activation means in order to designate visually at least one of said target zones for a predetermined period of time and to vary the location of said at least one visually designated target zone, said digital programming means being further capable of (1) repetitively comparing the signals controlling said selective activation means with the signals received from said detection means so as to determine for each such passage whether or not said at least one object passes through said target area within said at least one visually designated target zone, (2) tallying the successive passages of said at least one object through the target area from one side of said frame to the other in at least one direction in response to propulsion of said at least one object by said at least one player, and computing a score for said at least one player based thereon in accordance with a set of predetermined rules stored in said storage means, said score being based primarily upon the respective locations of the target zones through which said at least one object successively passes, and (3) depicting said score on said at least one display.

3. An apparatus in accordance with claim 2 further comprising a game court of predetermined dimensions on which said frame is situated, the edges of said game court defining the boundaries for permissible play of said game.

4. A programmable electronic digital apparatus comprising (a) digital storage means, (b) digital input means, (c) output means comprising at least one display, and (d) digital programming means capable of depicting on said at least one display a target apparatus comprising a frame comprised of two pairs of opposing wall elements, the wall elements of the first said pair being oriented in parallel spaced relation with one another and the wall elements of the second said pair being oriented in parallel spaced relation with one another, each wall element of the second said pair being oriented perpendicularly to the wall elements of the first said pair to define a target area within said frame, said digital programming means being further capable of (1) depicting on said at least one display (i) the subdivision of said target area into a plurality of target zones, each one of said target zones being selectively visually differentiable from the remainder of said target zones to a user of said apparatus, (ii) the visual designation to said user of at least one of said target zones for a predetermined period of time while varying the apparent location of said at least one visually designated target zone, and (iii) the repetitive transverse passage through said target area from one side of said frame to the other of at least one moving object in response to commands received through said input means, (2) determining for each such passage whether or not said at least one object passes through said target area within said at least one visually designated target zone, (3) tallying the successive passages of said at least one object through the target area from one side of said frame to the other in at least one direction, and computing at least one score based thereon in accordance with a set of predetermined rules stored in said storage means, said at least one score being based primarily upon the respective locations of the target zones through which said at least one object successively passes, and (4) depicting said at least one score on said at least one display.

5. A programmable electronic digital apparatus for simulating a target game for play by at least one player, said apparatus comprising (a) digital storage means, (b) digital input means, (c) output means comprising at least one display, and (d) digital programming means capable of depicting on said at least one display a target apparatus comprising a frame comprised of two pairs of opposing wall elements, the wall elements of the first said pair being oriented in parallel spaced relation with one another and the wall elements of the second said pair being oriented in parallel spaced relation with one another, each wall element of the second said pair being oriented perpendicularly to the wall elements of the first said pair to define a target area within said frame, said digital programming means being further capable of (1) depicting on said at least one display (i) the subdivision of said target area into a plurality of target zones, each one of said target zones being selectively visually differentiable from the remainder of said target zones to said at least one player, (ii) the selective visual designation to said at least one player of at least one of said target zones for a predetermined period of time while varying the apparent location of said at least one visually designated target zone, and (iii) the repetitive transverse passage through said target area from one side of said frame to the other of at least one moving object in response to commands received from said at least one player through said input means, (2) determining for each such passage whether or not said at least one object passes through said target area within said at least one visually designated target zone, (3) tallying the successive passages of said at least one object through the target area from one side of said frame to the other in at least one direction, and computing a score for said at least one player based thereon in accordance with a set of predetermined rules stored in said storage means, said score being based primarily upon the respective locations of the target zones through which said at least one object successively passes, and (4) depicting said score on said at least one display.

6. An apparatus in accordance with claim 5 wherein said digital programming means is further capable of depicting on said at least one display a game court of predetermined dimensions on which said frame is situated, the edges of said game court defining the boundaries for permissible play of said game.

7. A method for enabling the playing of a target game by at least one player, said method comprising the steps of:

(a) providing a frame comprised of two pairs of opposing wall elements, the wall elements of the first said pair being oriented in parallel spaced relation with one another and the wall elements of the second said pair being oriented in parallel spaced relation with one another, each wall element of the second said pair being oriented perpendicularly to the wall elements of the first said pair to define a target area within said frame, (b) providing means for physically subdividing said target area into a plurality of target zones, (c) providing means for enabling selective visual differentiation by said at least one player of each one of said target zones from the remainder of said target zones, said visual differentiation enabling means comprising selectively illuminateable regions of said subdividing means, (d) providing means for detecting the repetitive transverse passage through said target area from one side of said frame to the other of at least one moving object, for each such passage said detection means being capable of determining, and having output means for generating signals specifying, the direction in which said at least one object passes through said target area and the location of the particular target zone through which said at least one object passes, (e) providing means to enable said at least one player to propel said at least one object toward said frame in a repetitive fashion, and (f) providing a programmable digital electronic apparatus comprising (i) digital storage means, (ii) output means comprising at least one display and further comprising means for selectively activating said visual differentiation enabling means so as to visually designate to said at least one player at least one of said target zones, (iii) input means comprising means for receiving and processing signals from said detection means, and (iv) digital programming means capable of controlling said selective activation means in order to designate visually at least one of said target zones for a predetermined period of time and to vary the location of said at least one visually designated target zone, said digital programming means being further capable of (1) repetitively comparing the signals controlling said selective activation means with the signals received from said detection means so as to determine for each such passage whether or not said at least one object passes through said target area within said at least one visually designated target zone, (2) tallying the successive passages of said at least one object through the target area from one side of said frame to the other in at least one direction in response to propulsion of said at least one object by said at least one player, and computing a score for said at least one player based thereon in accordance with a set of predetermined rules stored in said storage means, said score being based primarily upon the respective locations of the target zones through which said at least one object successively passes, and (3) depicting said score on said at least one display.

8. A method for enabling the playing of a target game by at least one player on a programmable electronic digital apparatus, said method comprising the step of providing such an apparatus comprising (a) digital storage means, (b) digital input means, (c) output means comprising at least one display, and (d) digital programming means capable of depicting on said at least one display a target apparatus comprising a frame comprised of two pairs of opposing wall elements, the wall elements of the first said pair being oriented in parallel spaced relation with one another and the wall elements of the second said pair being oriented in parallel spaced relation with one another, each wall element of the second said pair being oriented perpendicularly to the wall elements of the first said pair to define a target area within said frame, said digital programming means being further capable of (1) depicting on said at least one display (i) the subdivision of said target area into a plurality of target zones, each one of said target zones being selectively visually differentiable from the remainder of said target zones to said at least one player, (ii) the selective visual designation to said at least one player of at least one of said target zones for a predetermined period of time while varying the apparent location of said at least one visually designated target zone, and (iii) the repetitive transverse passage through said target area from one side of said frame to the other of at least one moving object in response to commands received from said at least one player through said input means, (2) determining for each such passage whether or not said at least one object passes through said target area within said at least one visually designated target zone, (3) tallying the successive passages of said at least one object through the target area from one side of said frame to the other in at least one direction, and computing a score for said at least one player based thereon in accordance with a set of predetermined rules stored in said storage means, said score being based primarily upon the respective locations of the target zones through which said at least one object successively passes, and (4) depicting said score on said at least one display.

9. An apparatus in accordance with claims 7 or 8 wherein said digital programming means is further capable of depicting on said at least one display a game court of predetermined dimensions on which said frame is situated, the edges of said game court defining the boundaries for permissible play of said game.

* * * * *